US010928067B2

(12) United States Patent
Sze et al.

(10) Patent No.: US 10,928,067 B2
(45) Date of Patent: Feb. 23, 2021

(54) DOUBLE SKIN COMBUSTOR

(71) Applicant: PRATT & WHITNEY CANADA CORP., Longueuil (CA)

(72) Inventors: Robert Sze, Mississauga (CA); Sri Sreekanth, Mississauga (CA); Honza Stastny, Ottawa (CA); Jeffrey Verhiel, Mono (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 424 days.

(21) Appl. No.: 15/798,906

(22) Filed: Oct. 31, 2017

(65) Prior Publication Data

US 2019/0128523 A1 May 2, 2019

(51) Int. Cl.

| | |
|---|---|
| ***F23R 3/00*** | (2006.01) |
| ***F23R 3/04*** | (2006.01) |
| ***F23R 3/06*** | (2006.01) |

(52) U.S. Cl.

CPC ..... *F23R 3/04* (2013.01); *F23R 3/002* (2013.01); *F23R 3/005* (2013.01); *F23R 3/06* (2013.01); *F23R 2900/00017* (2013.01); *F23R 2900/03042* (2013.01); *F23R 2900/03043* (2013.01); *F23R 2900/03044* (2013.01)

(58) Field of Classification Search

CPC .... F23R 3/42; F23R 3/60; F23R 3/002; F23R 2900/00017; F23R 2900/03042; F23R 2900/03043; F23R 2900/03044; F23R 3/54; F23R 3/08; F05D 2240/90; F01D 25/26

See application file for complete search history.

(56) References Cited

U.S. PATENT DOCUMENTS

| | | | | |
|---|---|---|---|---|
| 4,686,823 | A | 8/1987 | Coburn et al. | |
| 5,758,504 | A * | 6/1998 | Abreu | F23R 3/002 60/754 |
| 6,079,199 | A | 6/2000 | McCaldon et al. | |
| 9,657,949 | B2 | 5/2017 | Stastny et al. | |
| 2014/0238031 | A1 | 8/2014 | Okita et al. | |
| 2015/0285497 | A1* | 10/2015 | Sandoval | F23R 3/045 60/754 |
| 2015/0354818 | A1* | 12/2015 | Lebel | F23R 3/002 60/796 |
| 2019/0032920 | A1* | 1/2019 | Giambra | F02C 3/145 |

* cited by examiner

*Primary Examiner* — Gerald L Sung
*Assistant Examiner* — Alyson Joan Harrington
(74) *Attorney, Agent, or Firm* — Norton Rose Fulbright Canada LLP

(57) ABSTRACT

There is disclosed a double skin combustor for a gas turbine engine. The combustor has a radially inner liner and a radially outer liner defining therebetween an annular combustion chamber. The radially inner liner and the radially outer liners both have a hot skin and a cold skin defining a cooling cavity therebetween. The cold skin has a plurality of segments joined to one another by sliding joints. The cooling cavity between the hot skin and the cold skin may be compartmentalized into individual cavities between the sliding joints.

20 Claims, 7 Drawing Sheets

DOUBLE SKIN COMBUSTOR

TECHNICAL FIELD

The application relates generally to gas turbine engines and, more particularly, to combustors used in such engines.

BACKGROUND OF THE ART

In a combustor of a gas turbine engine, fuel is mixed with air and ignited to generate hot combustion gases. In order to minimize heat-imparted wear, a portion of the combustor is provided with holes through which cooling air passes to remove heat from the combustor by convection. The turbulence of combustion gases within the combustor leads to rapid degradation of the air film cooling adjacent the hot combustor walls. Particularly where the hot combustion gases are being redirected as in a large exit duct of a reverse flow combustor, an interaction between turbulent combustion gases and the cool air film along the hot combustor wall leads to rapid deterioration of the cooling air film. As a result, it is generally necessary to increase the volume and flow rate of cooling air in such critical areas. Introduction of cooling air may not be optimally efficient for the completion of combustion nor for the presentation of hot combustion gases to the turbines. However, for lack of a better solution, designers have conventionally accepted a degree of inefficiency caused by excessive use of cooling air film as a necessary part of combustor design. One solution is to typically lined the inner hot skin with casted tiles which are to be attached to the cold skin with stud and nut arrangements. These arrangements are complicated, heavy, expensive and the studs or nuts may come loose and fall through the hot end causing excessive engine damage or even in flight shut down. The large peripheral of the tiles are also gaps of leakages which waste valuable coolant, causing combustion in-efficiency.

SUMMARY

In accordance with a general aspect there is provided a double skin combustor for a gas turbine engine, comprising: a radially inner liner and a radially outer liner extending from a combustor dome to a combustor outlet to define a combustion chamber, the radially inner liner and the radially outer liner each having a hot skin and a cold skin spaced-apart to define a cooling cavity therebetween, the cold skin of both the radially inner liner and of the radially outer liner comprising a plurality of segments extending from the combustor dome to the combustor outlet and connected by sliding joints configured to allow relative sliding movement between adjacent segments of the cold skin.

In accordance with another general aspect there is provided a combustor skin assembly for a gas turbine engine, the assembly comprising: a radially inner liner and a radially outer liner extending from a combustor dome to a combustor outlet and defining therebetween a combustion chamber, the radially outer liner having a hot skin and a cold skin defining a cooling cavity therebetween, the cold skin comprising a plurality of segments and sliding joints between the plurality of segments of the cold skin, wherein the cooling cavity is divided into individual sub-cavities from the combustor dome to the combustor outlet, each of the individual sub-cavities being bordered on at least one end thereof by one of the sliding joints.

In accordance with a further general aspect there is provided a method of assembling a double skin combustor having a radially inner liner and a radially outer liner both having a hot skin and a cold skin, comprising: joining segments of the cold skin of the radially outer liner to the hot skin of the radially outer liner via sliding joints; joining segments of the cold skin of the radially inner liner to the hot skin of the radially inner liner via sliding joints; and attaching the radially inner liner to the radially outer liner to define an annular combustion chamber of the double skin combustor.

DESCRIPTION OF THE DRAWINGS

Reference is now made to the accompanying figures in which.

DETAILED DESCRIPTION

Figure 1:
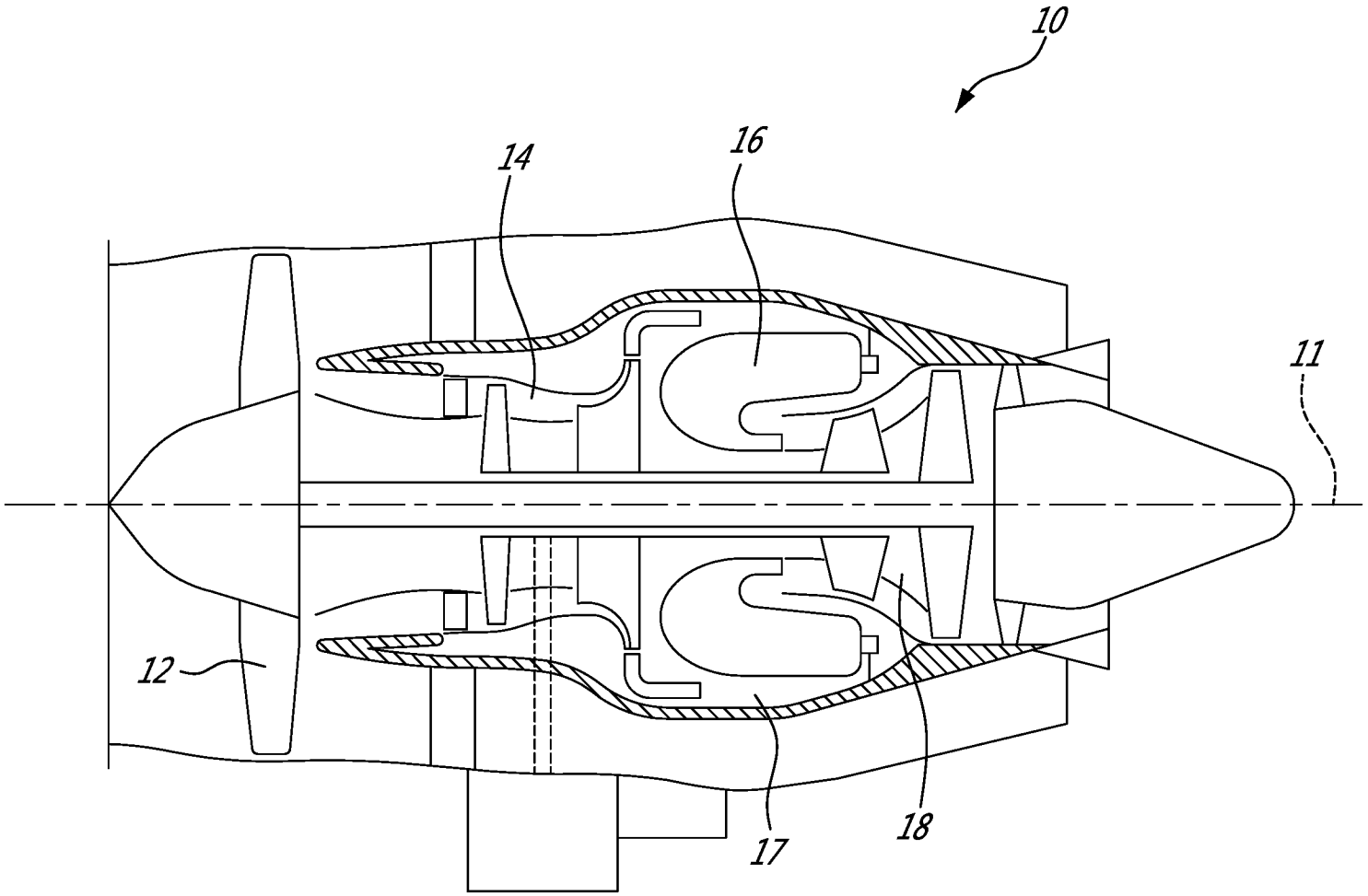
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases.

Figure 2:
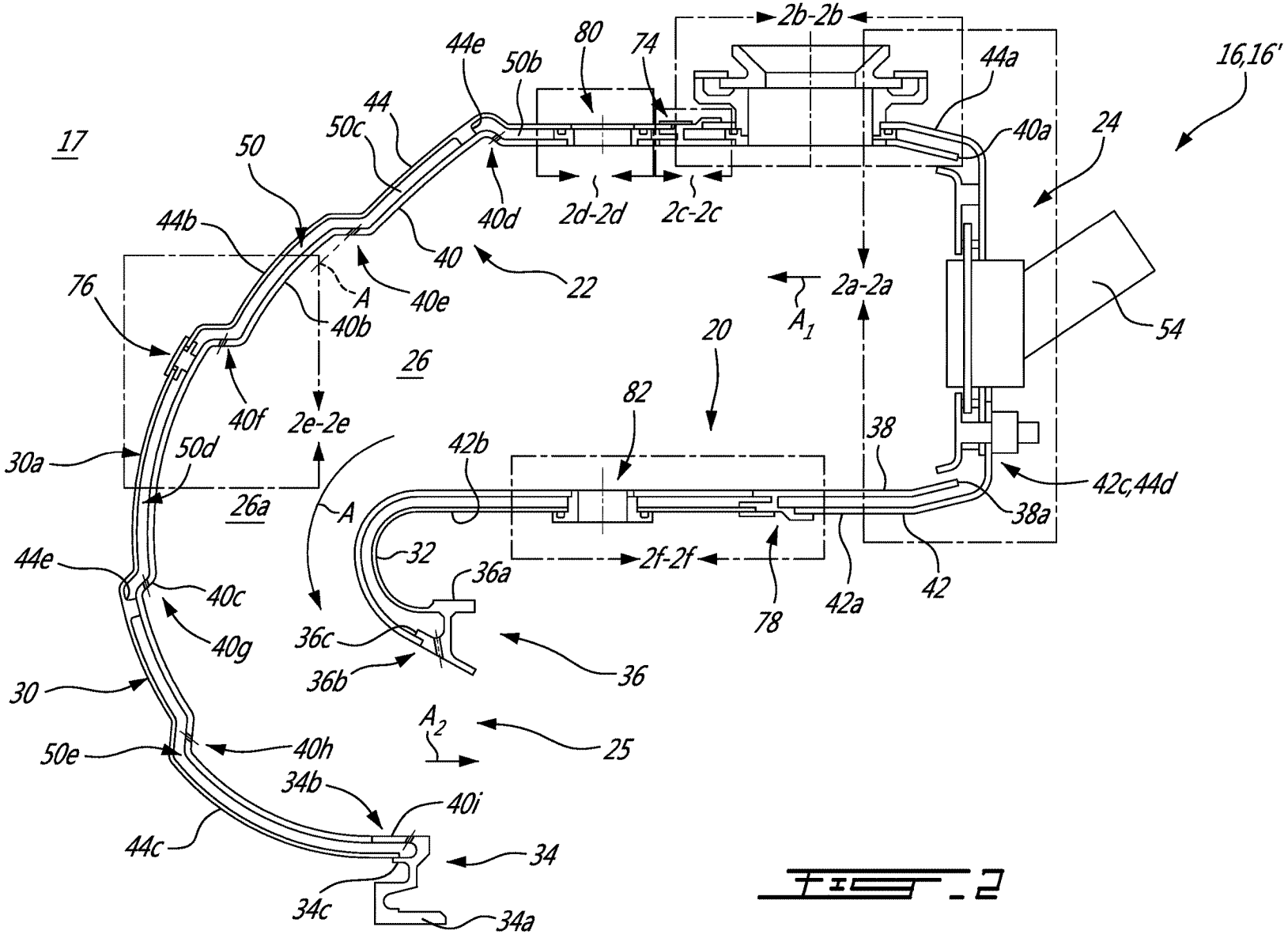
FIG. 2 is a schematic cross-sectional view of a double skin sheet metal combustor of the exemplary engine shown in FIG. 1.

Referring now to FIGS. 1-2, the combustor 16 is an annular reverse flow combustor mounted centrally about the engine centerline 11 in a plenum 17 fed with compressor bleed air. The combustor 16 includes a combustor skin assembly 16'. The combustor skin assembly 16' has a radially inner liner 20 and a radially outer liner 22 extending from a combustor dome 24 to a combustor outlet 25. The inner liner 20, the outer liner 22 and the dome 24 define an annular combustion chamber 26. The inner liner 20 and the outer liner 22 respectively have an elbow portion respectively commonly referred to as a small exit duct (SED) 32 and a large exit duct (LED) 30. The LED 30 and the SED 32 define a curved portion 26*a* of the combustion chamber 26.

Circumferentially spaced-apart fuel nozzles such as the one shown at 54 in FIG. 2 extend through the dome 24 for spraying fuel in an atomized state into the combustion chamber 26. Ignitors (not shown) are provided to ignite the air-fuel mixture. The combustion gases travel in the combustion chamber 26 in a first axial direction A1 (towards the left in FIG. 2) opposite the general gas path direction across the engine, prior to elbowing and exiting the combustion chamber 26 in a second axial direction A2 (towards the right in FIG. 2) opposite to the first direction A1. For the sake of clarity, the terms "upstream" and "downstream" used herein are in reference to the flow of combustion gases circulating within the combustor 16.

The outer liner 22 extends from the combustor dome 24 to an end of the LED 30, referred to herein as LED end 34, which is adjacent the turbine section 18. Similarly, the radially inner liner 20 extends from the combustor dome 24 to an end of the SED 32, referred to herein as SED end 36, which is adjacent the turbine section 18. The LED end 34 and the SED end 36 correspond to the outlet end 25 of the combustor 16.

Because of the high temperature of the combustion gases, it might be necessary to protect the radially inner and outer liners 20, 22 against heat-imparted wear. In the embodiment shown, the radially inner liner and the radially outer liner 20, 22 have a double walled construction. More particularly, the radially inner liner and the radially outer liner 20, 22 include each an inner, or hot skin 38, 40 and an outer, or cold skin 42, 44 over all the extent thereof (i.e. from the combustor dome 24 to the combustor outlet 25). The inner skins 38, 40 are directly exposed to the combustion gases whereas the outer skins 42, 44 are spaced apart from the inner skins 38, 40 by a cooling cavity or air gap 50 defined therebetween. The gap 50 extends an entire length of both the inner and outer liners 20, 22. Stated otherwise, the outer skins 42, 44 are spaced from the inner skins 38, 40 by the gap 50 all around the combustion chamber 26 between the combustor dome 24 and the combustor outlet 25. As will be discussed herein below, the gap 50 is configured for receiving compressed air from the plenum 17 for cooling purposes. The inner and outer skins 38, 40, 42, 44 are made of sheet metal material known in the art as being resistant to the conditions of use in a combustor, such as nickel-chromium, or cobalt based super alloys manufactured under the trademark INCONEL or HAYNES 214, 188, or 230, for instance. For the sake of clarity, the inner and outer skins 40, 44 of the radially outer liner 22 are referred herein as the outer liner inner skin 40 and the outer liner outer skin 44, respectively. Similarly, the inner and outer skins 38, 42 of the radially inner liner 20 are referred herein above as the inner liner inner skin 38 and the inner liner outer skin 42, respectively.

However, a problematic might arise by having the gap 50 extending all around the combustor 16 from the dome to the outlet end. Indeed, having the inner skins 38, 40 of the inner and outer liners 20, 22 directly exposed to the hot combustion gases and the outer skins 42, 44 separated from the hot combustion gases by the inner skins 38, 40 and by the gap 50 might generate thermal fight between the inner and outer skins. Stated otherwise, a thermal dilatation of the inner skins 38, 40 might be different than that of the outer skins 42, 44. Such a difference in the thermal growth might induce thermal stress between the inner and outer skins, which may be detrimental to the combustor 16. This problematic is addressed by segmenting at least the outer skins 42, 44 into segments that may move relative to one another following thermal expansion.

Referring more particularly to FIG. 2, the outer liner inner skin 40 extends monolithically from a free end 40*a* located adjacent the combustor dome 24 to the LED end 34. Similarly, the inner liner inner skin 38 extends monolithically from a free 38*a* end located adjacent the combustor dome to the SED end 36.

In the embodiment shown, the outer liner outer skin 44 includes a dome segment 44*a*, an upstream LED segment 44*b*, and a downstream LED segment 44*c*. The upstream and downstream LED segments 44*b*, 44*c* are located at the large exit duct 30. The inner liner outer skin 42 includes a connecting segment 42*a* and a SED segment 42*b*. The latter defines the small exit duct 32. The different segments of the inner and outer liners outer skins 42, 44 are separated from each other by sliding joints to cater to the difference in thermal dilatation of the outer skins 42, 44 relative to the inner skins 38, 40. The different outer skin sliding joint constructions used to account for the mounting of various features, such as ignitor and dilutions bosses, on the combustor shell and, thus, allow for a fully double skin combustor with a cold skin slip assembly will be introduced and described in further details herein below.

Figure 2A:
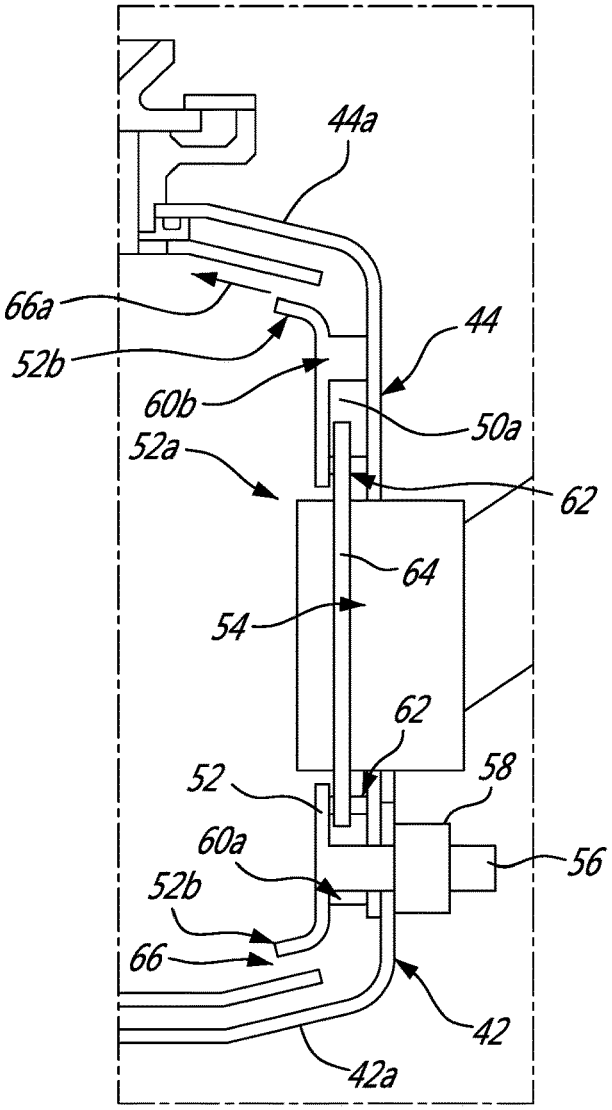
FIGS. 2*a* to 2*f* are schematic cross-sectional views illustrating various sliding joint construction details of the cold skin of the combustor shown in FIG. 2.

A double skin sheet metal combustor dome construction can be achieved with the exemplary features illustrated FIGS. 2 and 2*a*. According to the illustrated exemplary embodiment, the combustor dome 24 is defined by a cooperation of a portion of the dome segment 44*a* of the outer liner outer skin 44 that extends radially inward relative to the axis 11 (FIG. 1) and by a portion of the connecting segment 42*a* of the inner liner outer skin 42 that extends radially outward. The outer skin segments 44*a*, 42*a* radially overlap each other. Registering apertures 42*c*, 44*d* are defined through the dome and connecting segments 42*a*, 44*a* for attachment by fasteners as will be seen in further details herein below.

The combustor 16 further includes a dome inner skin 52 attached to the dome segment 44*a* of the outer liner outer skin 44. Apertures 52*a* are defined through the dome inner skin 52 and through the dome segment 44*a* of the outer liner outer skin 44 for receiving therein a fuel nozzle 54. The fuel nozzle 54 is configured for injecting fuel in the combustion chamber 26. It is understood that although only one fuel nozzle is illustrated in FIG. 2, the combustor includes a plurality of fuel nozzles circumferentially distributed around the axis 11 in FIG. 1.

Studs 56 are brazed on the dome inner skin 52 or are integral parts of the inner skin 52 (e.g. by additive manufacturing) and extend therefrom toward the outer liner outer skin 44. The studs 56 are received within the registering apertures 42*c*, 44*d* defined through the outer skin segments 44*a*, 42*a* where they overlap. Nuts 58 are screwed on the studs 56 to attach the outer liner 22, the dome inner skin 52, and the inner liner 20 together. In the embodiment shown, the apertures 42*c* defined through the inner liner outer skin 42 are elongated to allow the dome inner skin 52 to slide with thermal variations relative to the inner liner outer skin 42.

The dome inner skin 52 is axially spaced apart from the dome segment 44*a* by annular inner and outer rails 60*a*, 60*b* each radially spaced apart and extending circumferentially around the central axis 11. The annular outer rail 60*b* is welded on the dome segment 44*a* of the outer liner outer skin 44 for attachment. The annular inner rail 60*a* sealingly abuts on the connecting segment 42*a* of the inner liner outer skin 42, but may slide relatively therewith to cater to the thermal expansion difference between the inner and outer skins. As illustrated, the gap 50 includes a seal cavity 50*a* that is defined between the dome inner skin 52 and the dome segment 44*a* of the outer liner outer skin 44 for protection against thermal imparted wear.

In the embodiment shown, a circular rail 62 extends circumferentially around the flow nozzle 54 and is welded or brazed to the dome inner skin 52 and is in abutment against the dome segment 44*a* of the outer liner outer skin 44. The circular rail 62 may be made by a suitable additive manufacturing process. The circular rail 62 defines inner bounds of the seal cavity 50*a* of the gap 50. In other words, the seal cavity 50*a* is fluidly disconnected from the plenum 17 by the circular rail 62. In the embodiment shown, the combustor 16 further includes a floating collar 64 attached to the circular rails 62. The floating collar 64 is configured for receiving therein the fuel nozzle 54. The ID of the floating collar closely corresponds to the OD of the nozzle.

In a particular embodiment, the circular rails 62 abut tightly against the dome segment 44*a* of the outer liner outer skin 44 such that air leakage from the gap 50 is minimized. In this area, air leakage is not only wasteful but might impact the stability of the combustion process, the lean blow out and the altitude re-light envelope. It might affect the engine overall fuel consumption. Therefore, it is of a particular importance to limit air leakage from the gap especially near the fuel nozzle where a primary combustion zone is located. To reinforce the above, the air within the gap 50 comes from a high-pressure section of the compressor 14. Therefore, the air in the gap 50 is very expensive to produce and as such leakages must be limited.

The dome inner skin 52 defines two lips 52*b* at radially outer and inner ends. Each of the two lips 52*b* of the dome inner skin 52 discontinued from the inner skins 38, 40 to define annular gaps 66 with the free ends 38*a*, 40*a* of the inner skins 38, 40. The annular gaps 66 provide fluid communication between the combustion chamber 26 and the gap 50 to provide film cooling of the inner side of the inner and outer liners inner skins 38, 40. As illustrated, the annular gaps 66 define exit flow axis 66*a* aligned substantially parallel to the inner skins 38, 40 and oriented axially rearward relative to the central axis 11. Compressed air circulating in the combustion chamber 26 from the annular gaps 66 flows in a direction substantially parallel to the combustion gases.

Figure 2B:
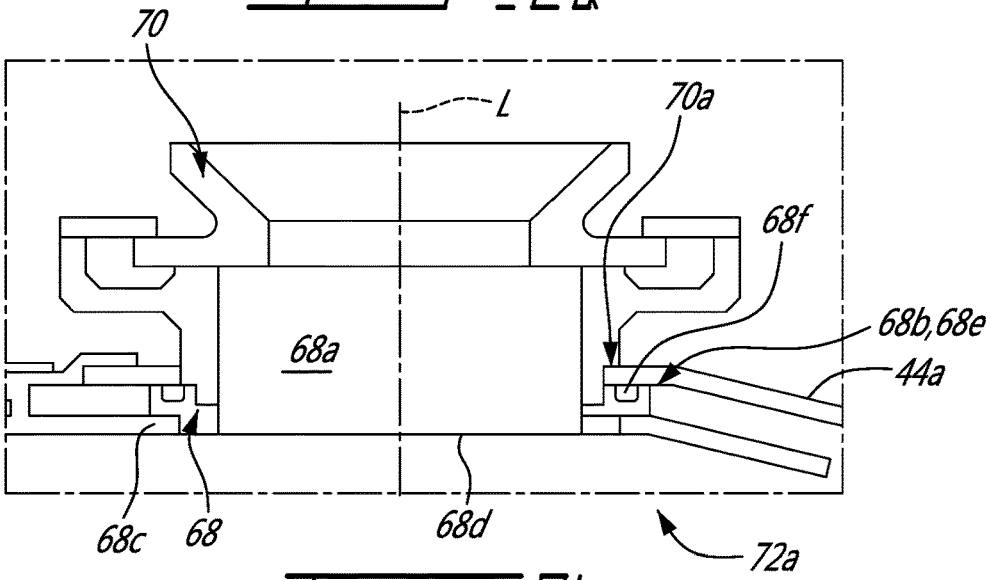

The combustor 16 further includes ignitors for igniting a mixture of air and fuel. The ignitors can be integrated to the combustor skin assembly 16' with the exemplary features illustrated in FIGS. 2 and 2*b*. According to the illustrated embodiment, the combustor 16 further includes an ignitor boss 68 mounted on the outer liner 22. The ignitor boss 68 is configured for receiving a floating collar assembly 70 that is used for holding an ignitor (not shown) for igniting the mixture of air and fuel. It is understood that although only one ignitor boss 68 is illustrated in FIG. 2, the combustor 16 may include a plurality of ignitor bosses 68 circumferentially distributed around the axis 11. In the embodiment shown, the ignitor boss 68 is located at the dome segment 44*a* of the outer liner outer skin 44 and is inserted in a corresponding aperture 72*a* defined through the outer liner inner and outer skins 40, 44.

The ignitor boss 68 has a cylindrical shape having an inner end 68*a* spaced apart from an outer end 68*b* relative to a longitudinal axis L oriented toward the central axis 11. A diameter of the ignitor boss 68 proximate the inner end 68*a* is less than that proximate the outer end 68*b* thereby defining an annular abutting surface 68*c*. The ignitor boss 68 is received in the corresponding aperture 72*a* such that an inner opening 68*d* is coplanar with the inner side of the outer liner inner skin 40. Once inserted in the aperture 72*a*, the annular abutting surface 68*c* abuts against of the outer liner inner skin 40 within the gap 50. In the embodiment shown, the ignitor boss 68 is welded to outer liner inner skin 40 via the annular abutting surface 68*c*. The floating collar assembly 70 is welded on the ignitor boss 68. The floating collar assembly defines an annular abutting surface 70*a* created by two sections of different diameters.

At the outer end 68*b*, the ignitor boss 68 defines an annular grooved surface 68*e* that defines a groove 68*f* circumferentially extending about the longitudinal axis L of the ignitor boss 68. This groove 68*f* is a double seal. The leak air has to contract-expend-contract before leaking through the boss/shell gap. Applicant has found that such contraction-expansion-contraction provide more resistance than a normal constant cross-section sealing gap. The annular grooved surface 68*e* is configured to contact the outer liner outer skin 44 that may slidably move relative to the ignitor boss 68 to cater to the thermal displacement. The annular grooved surface 68*e* is oriented radially outward relative to the central axis 11.

In a particular embodiment, thermal displacements of the outer liner outer skin 44 relative to the outer liner inner skin 40 are permitted via an interaction between the outer skin 44 and the annular grooved surface 68*e* of the ignitor boss 68.

The dome, upstream LED, and downstream LED segments 44*a*, 44*b*, 44*c*, should be able to move relative to the outer liner inner skin 40 to account for the variation in thermal dilatation. These segments may be integrated within the combustor skin assembly 16' with the exemplary features illustrated in FIG. 2. As illustrated, the upstream LED segment 44*b* is separated from the dome segment 44*a* by an outer sliding joint 74, and the downstream LED segment 44*c* is separated from the upstream LED 44*b* segment by a double sliding joint 76. The upstream LED segment 44*b* extends from the outer sliding joint 74 to the double sliding joint 76, which is located approximately at mid-length of the LED 30. The downstream LED segment 44*c* extends from the double sliding joint 76 to the LED end 34. Stated otherwise, the dome segment 44*a* is separated from the upstream LED segment 44*b* by the outer sliding joint 74. And, the upstream LED segment 44*b* is separated from the downstream LED segment 44*c* by the double sliding joint 76. The outer sliding joint 74 and the double sliding joints 76 are configured for allowing translational movements of the outer liner segments, that are the dome segment 44*a* and the upstream and downstream LED segments 44*b*, 44*c*, relative to one another and relative to the outer liner inner skin 40 such that thermal stresses between the outer liner inner and outer skins 40, 44 might be avoided or at least reduced compared to configuration free of such sliding joints.

Apertures 30*a* are defined through the upstream and downstream LED segments 44*b*, 44*c* of the outer liner outer skin 44 for fluidly connecting the plenum 17 with the gap 50. The apertures 30*a* allow compressed air form the compressor 16 to be injected in the gap 50 for cooling purposes. The compressed air from the compressor 16 may provide convection cooling when circulating through the apertures 30*a*, impingement cooling when entering the gap 50 via the apertures 30*a* and impinging the inner skin 40, and film cooling when circulating within the gap 50 substantially parallel to the inner and outer skins 40, 44.

The compressed air that is now in the gap 50 may be used to further cool, or protect, the inner skin 40 of the radially outer liner 22 at least at the large exit duct 30. In the embodiment shown, the inner skin 40, at the large exit duct 30, defines a plurality of alternating steps 40*b* and risers 40*c*, five steps 40*b* and five risers 40*c* in the embodiment shown. First, second, third, fourth, and fifth series of air holes 40*d*, 40*e*, 40*f*, 40*g*, 40*h* are each defined through a respective one of the five risers 40*c* to provide fluid flow communication between the gap 50 and the combustion chamber 26.

As illustrated, each of the air holes has an exit flow axis A aligned substantially parallel to one of the steps 40*b* that is downstream therefrom. Flows of air exiting the gap 50 via the holes 40*d*, 40*e*, 40*f*, 40*g*, 40*h* hence flow substantially parallel to the inner skin 40, inside the combustion chamber 26, in a downstream direction relative to the combustion gases, to create a film that might protect said inner skin 40 from the hot combustion gases. Hence, at the large exit duct 30, the compressed air is used four times for cooling the combustor: 1) impingement cooling against the outer liner inner skin 40, 2) backside convection cooling of the outer liner inner skin possibly through trip strips pin fins or any suitable turbulent promoters formed by additive manufacturing, 3) transpiration cooling through the effusion holes along the outer liner inner skin 40, and 4) film cooling along the outer liner inner skin 40 in the combustion chamber 26.

In the embodiment shown, the upstream and downstream LED segments 44*b*, 44*c* of the outer liner outer skin 44 define protrusions 44*e* that extend between the inner and outer skins 40, 44 of the radially outer liner 22 and that extend circumferentially around the axis 11. In the depicted embodiment, the protrusions 44*e* are monolithic with the outer liner outer skin 44 and are welded to the outer liner inner skin 40, such that, at these locations, the outer liner outer skin 44 moves integrally with the outer liner inner skin 40. Other configurations are contemplated. The protrusions 44*e* are disposed on both sides of the double sliding joint 76 and are spaced apart therefrom to define first 50*b*, second 50*c*, third 50*d*, and fourth 50*e* sub-cavities of the gap 50. The second, third, and fourth sub-cavities 50*c*, 50*d*, 50*e* extend along the large exit duct 30. Each of the sub-cavities 50*b*, 50*c*, 50*d*, 50*e* extends circumferentially around the axis 11.

Each of the five series of the air sub-cavities 50*b*, 50*c*, 50*d*, 50*e* are fed by arrays of impingement holes on the LED cold skins 30. Through these holes the air from annulus 17 impinge onto the LED hot skin 40. The spent flow travels along the cavities hot skin, which may been roughened with trip strips, pins or other turbulent promoters, cooling the skin. This flow then leave the cavities through effusion holes on the hot skin 40*d* 40*e*, 40*f* and 40*g*. and film cool the hot skin. The first series 40*d* is fluidly connected to the first cavity 50*b*, the second and third series 40*e*, 40*f* are fluidly connected to the second cavity 50*c*, the fourth series 40*g* is fluidly connected to the third cavity 50*d*, and the fifth series 40*h* is fluidly connected to the fourth cavity 50*e*.

In the embodiment shown, a sixth series of apertures 40*i* extend through the outer liner inner skin 40 and are located at the LED end 34. The fourth cavity 50*e* of the gap 50 is fluidly connected to the combustion chamber 26 through the fifth and sixth series of apertures 40*h*, 40*i*.

In a particular embodiment, compartmentalizing the gap in cavities allows individually optimizing the pressure differential between each of the cavities 50*b*, 50*c*, 50*d*, 50*e* and the combustion chamber 26. In the embodiment shown, the velocity of the combustion gases increases drastically through the passage between the LED 30 and SED 32 because a cross-sectional area between the LED and SED decreases toward the turbine section 18. Hence, the pressure of the hot combustion gases decreases as its velocity increases. The variation of the gas pressure within the combustion chamber 26 might lead to hot gas ingestion that impairs the inner skin 40 of the outer liner 22 at the large exit duct 30, ultimately, impairing the durability of the LED. In a particular embodiment, compartmentalizing the gap 50 in the three sub-cavities 50*c*, 50*d*, 50*e* at the LED 30 allows the pressure drop between each compartment and the combustion chamber to be optimized and avoid the hot gas ingestion. Having the series of air inlets 40*d*, 40*e*, 40*f*, 40*g*, 40*h*, 40*i* fluidly connected to sub-cavities 50*c*, 50*d*, 50*e* whose pressure differ from each other might allow optimizing the cooling along the outer liner inner skin 40 at the large exit duct 30. Another method of avoiding, or limiting, the hot gas ingestion would be to design the LED 30 with a higher pressure drop. However, this would reduce the combustor 16 and engine 10 overall performance, which is not desirable. The splitting of the gap 50 in multiple sub-cavities within the LED 30 might eliminate the need of a higher combustor pressure.

Figure 2C:
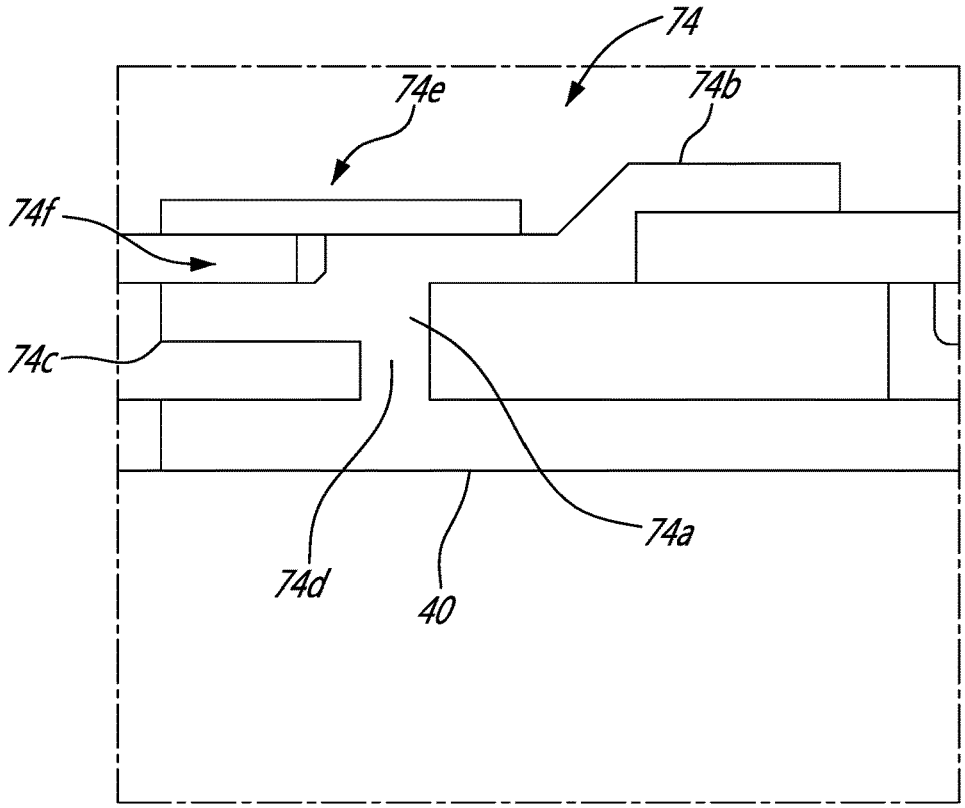

The outer sliding joint 74 is configured to allow the LED upstream segment 44*b* to move relative to the outer liner inner skin 40. The outer sliding joint 74 can be defined by the exemplary features illustrated in FIGS. 2 and 2*c*. As illustrated, the outer sliding joint 74 that is disposed between the outer liner outer skin main and upstream LED segments 44*a*, 44*b* includes a joint body 74*a* that may be either welded on the outer liner inner skin 40 or integrally formed therewith. The joint body 74*a* may be machined from a forging process. The joint body 74*a* includes aft 74*b* and fore tabs 74*c* extending substantially parallel to the outer liner inner skin 40 and radially spaced away therefrom by a spacer 74*d* of the joint body. The aft and fore tabs 74*b*, 74*c* extend axially in opposite direction from the spacer 74*d* and each extends circumferentially around the central axis 11.

The fore tab 74*c* is disposed radially inward of the outer liner outer skin 44 whereas the aft tab 74*b* is disposed radially outward of the outer liner outer skin 44. In the embodiment shown, the aft tab 74*b* is welded on the outer liner outer skin 44. The outer sliding joint 74 further includes a joint outer 74*e* disposed radially outward of the joint body 74*a* and welded on the joint body such as to define an annular slot 74*f* between the joint outer 74*e* and the fore tab 74*c* of the joint body 74*a*. The annular slot 74*f* extends circumferentially around the central axis 11. The upstream LED segment 44*b* of the outer liner outer skin 44 is slidably received within the annular slot 74*f* to be able to axially move with respect to the annular slot 74*f*.

The combustor 16 further includes an inner sliding joint 78 (FIGS. 2 and 2*a*) between the connecting segment 42*a* and the SED segment 42*b* of the inner liner outer skin 42. The inner sliding joint 78 has the same structure than the outer sliding joint 74. More specifically, the inner sliding joint 78 has a joint body having a fore tab and an aft tab. The aft tab is disposed radially inward of the connecting segment and welded thereon. The fore tab defines an annular slot with a joint outer. The SED segment 42*b* is sliding received in the annular slot.

Figure 2D:
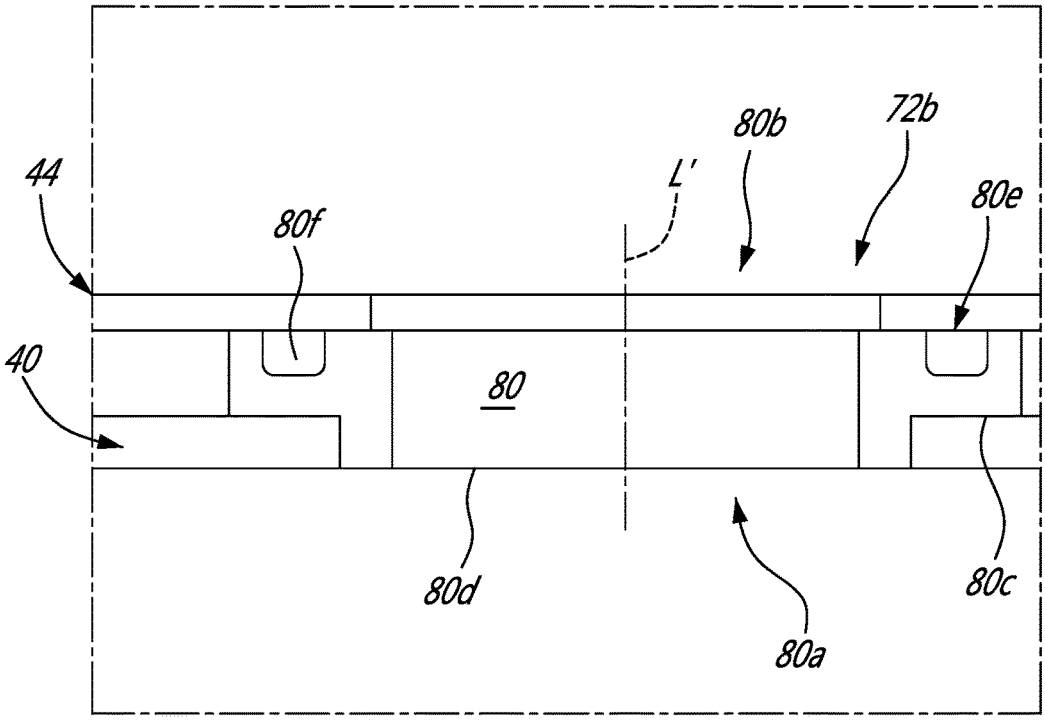
Figure 2E:
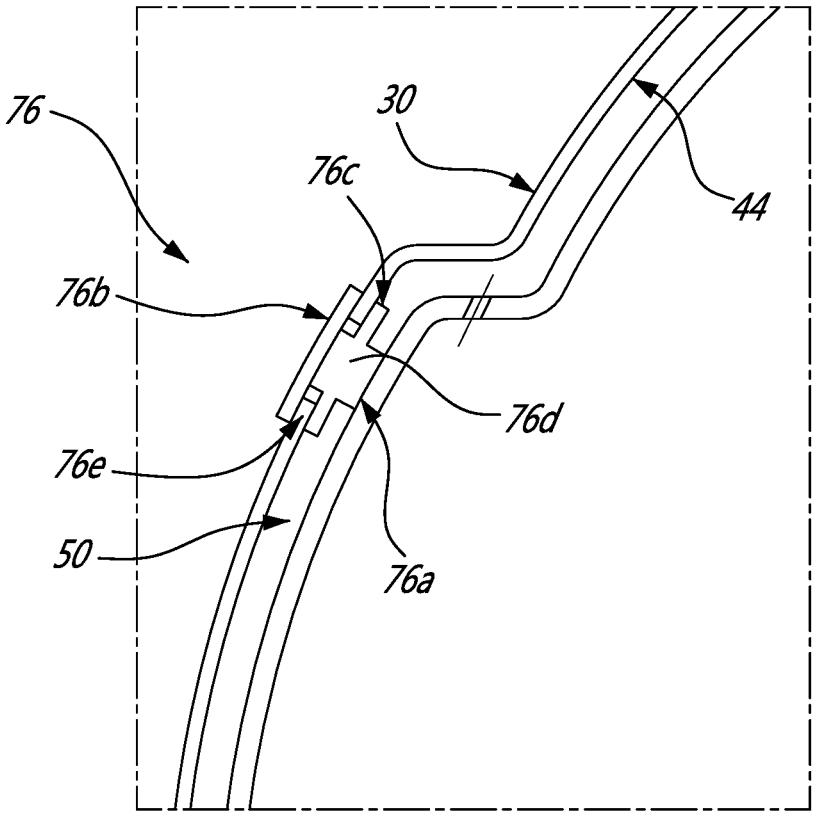

The combustor 16 further includes dilution bosses 80, 82 that may be integrated to the combustor skin assembly 16' with the exemplary features of FIGS. 2, 2*d*, and 2*e*. In the depicted embodiment, the combustor 16 includes an outer and an inner dilution boss 80, 82 that are mounted on the combustor outer and inner liners, respectively. Dilution bosses define dilution holes and are used to provide fluid flow communication between the plenum 17 and the combustion chamber 26 to inject dilution air from the plenum. The dilution air might cool the air before it reaches the turbine section 18. It is understood that although only one outer dilution boss 80 is illustrated in FIG. 2, the combustor 16 includes a plurality of outer dilution 80 bosses circumferentially distributed around the axis 11.

Referring more particularly to FIG. 2*d*, the outer dilution boss 80 has a cylindrical shape having an inner end 80*a* spaced apart from an outer end 80*b* relative to a longitudinal axis L' that is oriented toward the central axis 11 of the gas turbine engine 10. A diameter of the ignitor boss proximate the inner end 80*a* is less than that proximate the outer end 80*b* thereby defining an annular abutting surface 80*c*. The outer dilution boss 80 is received in a corresponding apertures 72*b* such that an inner opening 80*d* is coplanar with the inner side of the outer liner inner skin 40. Once inserted in the aperture 72*b*, the annular abutting surface 80*c* abuts against the outer liner inner skin 40 within the gap 50. In the embodiment shown, the outer dilution boss 80 is welded to the outer liner inner skin 40 via the annular abutting surface 80*c*.

At the outer end 80*b*, the outer dilution boss 80 defines an annular grooved surface 80*e* that defines a groove 80*f* circumferentially extending about the longitudinal axis L' of the outer dilution boss 80. The annular grooved surface 80*e* is configured to contact the outer liner outer skin 44 that may slidably move relative to the outer dilution boss 80 to cater to the thermal displacement. The groove may house a metal C seal. The annular grooved surface 80*e* is oriented radially outward relative to the central axis 11.

In the embodiment shown, in operation, the outer liner inner skin 40 tends to move radially outward whereas the outer liner outer skin 44 tends grows at a thermal growth rate less than that of the outer liner inner skin 40. Hence, an interference fit is created when the combustor 16 is in used. Stated otherwise, the outer liner inner skin 40 expands more than the outer liner outer skin 44 thereby radially compressing the ignitor and outer dilution bosses 70, 80 between the outer liner inner and outer skins 40, 44. In a particular embodiment, such a created interference fit decreases leaks from the combustion chamber 26 to the plenum 17. The annular abutting surface 70*a* of the ignitor boss floating collar assembly 70 abuts against the outer liner outer skin 44 and similarly creates an interference fit when the combustor 16 is in used.

Referring more particularly to FIG. 2*e*, the inner dilution boss 82 has a cylindrical shape extending circumferentially around a longitudinal axis L" thereof that is oriented toward the central axis 11. The inner dilution boss 82 has an annular tab 82*a* of a diameter greater than a diameter of a remainder of the inner dilution boss 82 and greater than a diameter of a respective one of the apertures 72*b* configured for receiving a portion of the inner dilution boss 82. Hence, once inserted in the respective one of the apertures 72*b*, the annular tab 82*a* abuts against the inner liner outer skin 42 outside the gap 50. The annular tab 82*a* has an annular grooved surface 82*b* that defines an annular groove 82*c* circumferentially extending around the longitudinal axis L". The annular grooved surface 82*b* is configured to abut against the inner liner outer skin 42, outside the gap 50, and is oriented radially outward relative to the central axis 11. In the embodiment shown, an inner end 82*d* of the inner dilution boss 82 is welded to the inner liner inner skin 38. An opening 82*e* defined by the inner end 82*d* of the inner dilution boss 82 is coplanar with the inner side of the inner liner inner skin 38.

The configuration of the inner dilution boss 82 is different than that of the outer dilution boss 80 because the thermal growth for the inner liner 20 is different than for the outer liner 22. In operation, the inner liner inner skin 38 moves radially outward and hence away from the inner liner outer skin 42 that grows at a thermal growth rate less than that of the inner liner inner skin 38. An interference fit is therefore created by having the inner dilution boss 82 moving radially outward with the inner liner inner skin 38. This movement increases a contacting force between the annular tab 82*a* of the inner dilution boss 81 and the inner liner outer skin 42. In a particular embodiment, such a created interference fit decreases leaks from the combustion chamber 26 to the plenum 17.

Figure 2F:
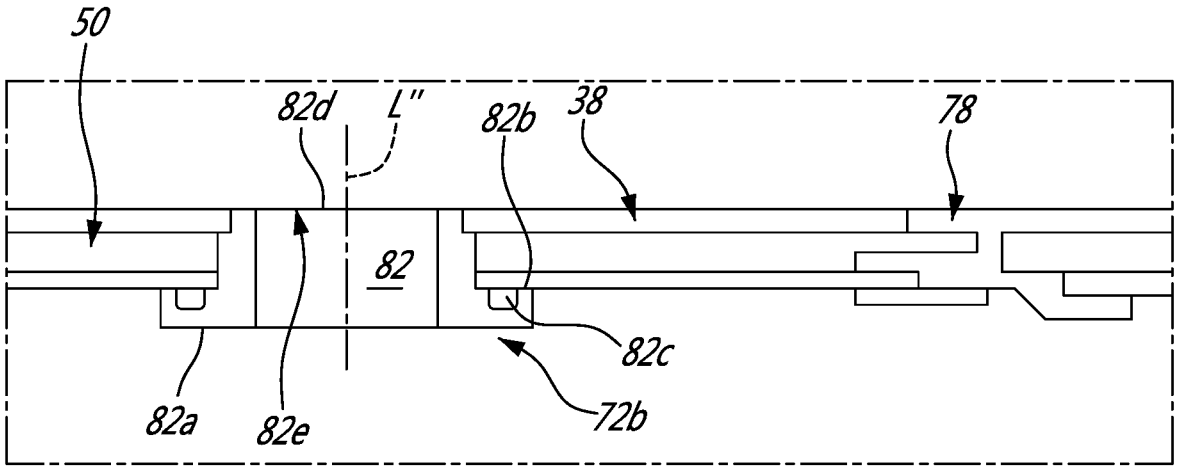

The double sliding joint 76 (FIGS. 2 and 2*f*) is used to allow both the upstream and downstream LED segments 44*b*, 44*c* to move relative to the outer liner inner skin 40. The double sliding joint 76 can be defined via the exemplary features illustrated in FIGS. 2 and 2*f*. As shown, the double sliding joint 76 that is disposed between the outer liner outer skin upstream and downstream LED segments 44*b*, 44*c* is illustrated. The double sliding joint 76 includes an inner piece 76*a* and an outer piece 76*b*, both extending circumferentially around the axis 11. The inner skin 40 is a sheet metal piece formed from Haynes 188, 230, 214 or high oxidation resistance formable sheet metal. The inner sliding joint piece 76*a* may be machined out of a forging. Alternately, the inner sliding joint piece 76*a* may be monolithic with the outer liner inner skin 40. The inner sliding joint piece 76*a* defines two tabs 76*c* extending in opposite directions from a central section 76*d* of the inner sliding joint piece 76*a*. In the embodiment shown, the two tabs 76*c* are spaced apart from the outer liner inner skin 40 and are located within the gap 50. The inner sliding joint piece 76*a* is welded to the inner skin 40 via the central section 76*d*. The outer piece 76*b* is welded to the central section 76*d* of the inner piece 76*a*. An assembly of the inner and outer pieces 76*a*, 76*b* defines two annular slots 76*e* separated by the central section 76*d* and extending circumferentially around the axis 11. The two annular slots 76*e* slidably receives a respective one of the upstream LED segment 44*b* and the outer downstream LED segment 44*c*. Hence, both segments of the LED 30 can slide freely inside the annular slots 76*e* of the double sliding joints 76 to absorb the thermal differential growth of the outer liner inner and outer skins 40, 44.

The outer and inner skins 38, 40, 42, 44 end at the LED and SED ends 34, 36 (FIG. 2). A coupling between the outer and inner skins at the LED and SED ends can be defined by the exemplary features illustrated in FIG. 2. As depicted, the LED and SED ends 34, 36 include attachment portions 34*a*, 36*a* configured to be connected to the turbine section 18. The attachment portion 36*a* of the SED end 36 is defined by the inner liner outer skin 42 whereas the attachment portion 34*a* of the LED end 34 is defined by the outer liner inner skin 40.

In the embodiment shown, the attachment portions 34*a*, 36*a* define sliding end joints 34*b*, 36*b* between the inner and outer skins. More specifically, the attachment portion 34*a* of the LED end 34 defines a tab 34*c* disposed radially inward of the outer liner outer skin 44 and on which the outer liner outer skin 44 abuts. Similarly, the attachment portion 36*a* of the SED end 36 defines a tab 36*c* disposed radially outward of the inner liner inner skin 38 and on which the inner liner inner skin 38 abuts. The tabs 34*c*, 36*c* and the skins 44, 38 overlap each other and are able to slide relative to one another to define the sliding end joints 34*b*, 36*b*. It is understood that a dimension of the overlap may vary depending on the temperatures of the inner and outer skins.

In operation, the outer liner inner skin 40 moves radially outward relative to the central axis 11 and pushes the outer liner outer skin 44 with the tab 34*c* to create a radial interference fit. Similarly, the inner liner inner skin 38 moves radially outward and pushes the inner liner outer skin 42 via the tab 36*c* to create a radial interference fit. Hence, leaks at the LED and SED ends 34, 36 might be limited or avoided.

In a particular embodiment, the problematic of thermal fighting discussed herein above is overcome by the use of the sliding joints. The sliding joints are configured to allow thermal dilation of the inner skins without imparting load to, or receiving load from, the outer skins.

All the above joints described joints are used to cater for the difference in thermal dilatation between the inner skins 38, 40 and the outer skins 42, 44. In a particular embodiment, thermal growth of the inner skins 38, 40 is not limited by the outer skins 42, 44 because the above described joints. In a particular embodiment, thermal fights between the inner and outer skins are avoided because of the joints.

The joints described herein above can be implemented in other ways by using, for instance, the exemplary features illustrated in FIG. 3, an alternate embodiment of a combustor 100 is illustrated. For the sake of simplicity, only elements that are different than the combustor 16 of FIG. 2 are described herein below. In the embodiment shown, the outer liner outer skin 144 includes four segments 144*a*, 144*b*, 144*c*, 144*d*. A first segment 144*a* extends from the combustor dome 24 to a first double sliding joint 102, a second segment 144*b* extends from the first double sliding joint 102 to a single sliding joint 104, a third segment 144*c* extends from the single sliding joint 104 to a second double sliding joint 106, and the fourth segment 144*d* extends from the second double sliding joint 106 to the LED end 34. In the embodiment shown, a gap 108 between outer liner inner and outer skins 140, 144 has four cavities 108*a*, 108*b*, 108*c*, 108*d*. The gap 108 has three cavities 108*e*, 108*f*, 108*g* between the inner liner inner and outer skins 38, 42.

The first double sliding joint 102 is composed of a first piece 102*a* extending circumferentially around the central axis 11. The first piece 102*a* is welded on the outer liner inner skin 40, or may be monolithically formed therewith. The first piece 102*a* defines two axially opposed annular slots 102*b* extending around axis 11 and configured for slidably receiving each a respective one of the first and second segments 144*a*, 144*b* of the outer liner outer skin 144.

A section of the second segment 144*b* of the outer liner outer skin 144 is directly welded on the outer liner inner skin 40. An annular slot 104*a* is defined between the second segment 144*b* and the outer liner inner skin 40. The annular slot 104*a* slidably receives therein the third segment 144*c* of the outer liner outer skin 144. This weld joint can be film cooled by the film cooling holes shown as black arrows 104*h*. Other sliding joint such as 106 can also be cooled with effusion holes 106*h*

The double sliding joint 106 is composed of a strip 106*a* made of sheet metal extending circumferentially around the central axis 11. The strip 106*a* is welded to the outer liner inner skin 40 and defines two annular slots 106*b* with the outer liner inner skin 40. The third and fourth segments 144*b*, 144*c* are slidably received in the annular slots 106*b* to allow movements caused by a difference in the thermal growth of the outer liner inner and outer skins 140, 144. In the embodiment shown, the strip 106*a* is cooled by effusion holes 106*c* defined therethrough and circumferentially distributed about axis 11.

Turning now to the inner liner 20, the inner liner outer skin 142 includes three segments 142*a*, 142, 142*c* and a third 110 and a fourth 112 double sliding joints of the combustor, which are disposed on opposite sides of the inner dilution boss. The first segment 142*a* is welded on the inner liner inner skin 38 at the combustor dome 24 and extends therefrom to the third double sliding joint 110. The second segment 142*b* extends from the third double sliding joint 110 to the fourth double sliding joint 112. The third segment 142*c* extends form the fourth double sliding joint to the SED end 36.

The third and fourth double sliding joints 110, 112 are identical, as such, only the third sliding joint 110 is described. The third sliding joint 110 includes a metal strip 110*a* having a "T"-shape cross-section. The metal strip 110*a* is welded on the inner liner inner skin 38 and defines two annular gaps 110*b* between the inner liner outer and inner skins 38, 142. The first and second segments 142*a*, 142*b* of the inner liner outer skin 142 are slidably received each within a respective one of the two annular gaps 110*b*.

A radial interference fit is created when in used because the inner liner inner skin 38 moves radially inward and entrain the same movement to the metal strip 110*a* which thereby pushes the inner liner outer skin 142 radially outwardly. The interference fit created by the third and fourth double sliding joints 110, 112 might reduce leaks of combustion gases. This sliding joint is a simpler, lighter and less costly design.

Figure 4:
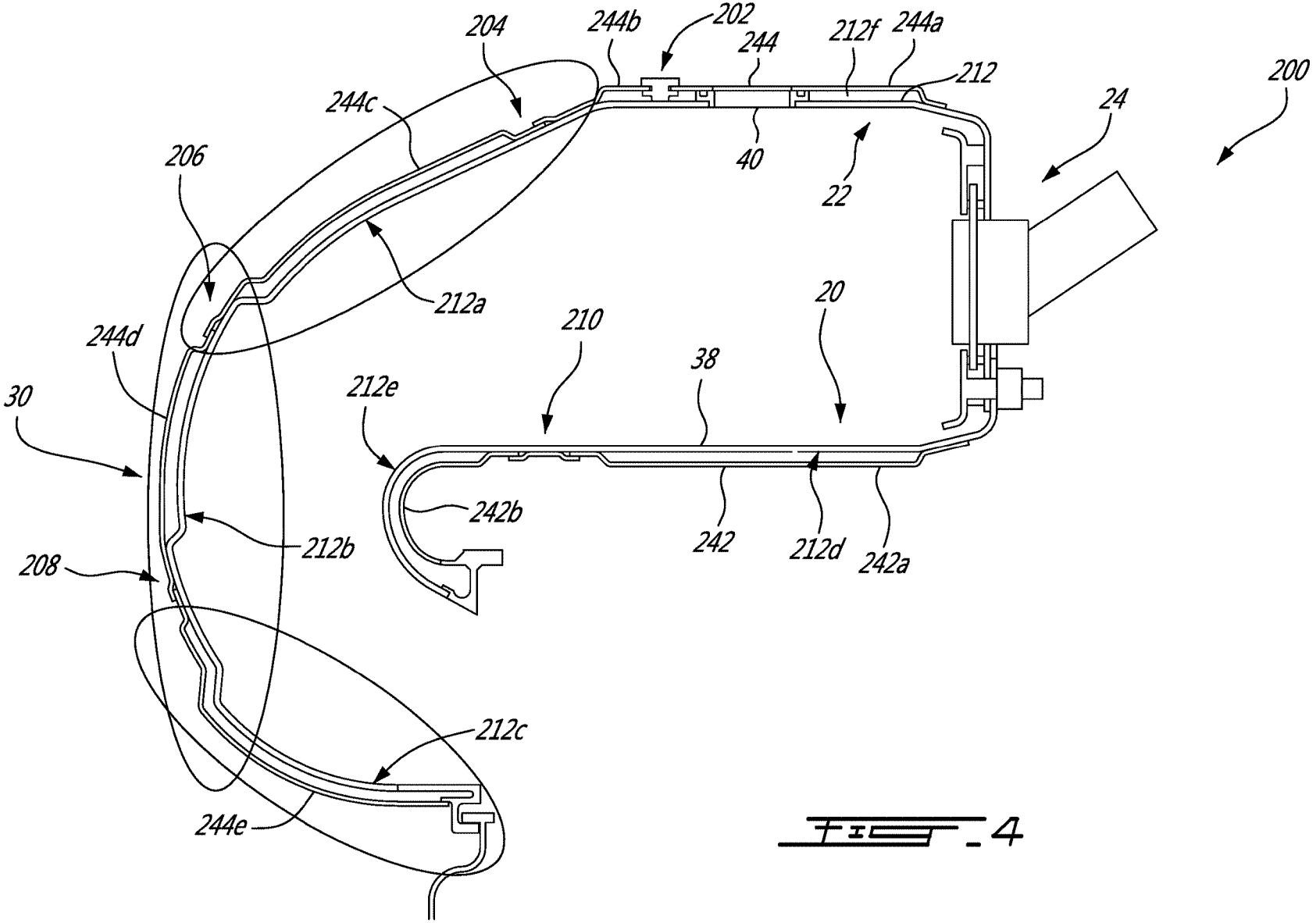
FIG. 4 is a schematic cross-sectional view of a further example of a double skin sheet metal combustor.

The joints described herein above can be implemented in further other ways by using, for instance, the exemplary features illustrated in FIG. 4, yet another embodiment of a combustor 200 is illustrated. In the embodiment shown, the outer liner outer skin 44 includes five segments 244*a*, 244*b*, 244*c*, 244*d*, 244*e* whereas the inner liner outer skin 242 includes two segments 242*a*, 242*b*. The outer liner outer skin first and second segments 244*a*, 244*b* are joined via a first double sliding joint 202. The second and third segments 244*b*, 244*c* are joined by a first single sliding joint 204. The third and fourth segments 244*c*, 244*d* are joined by a second single sliding joint 206. And, the fourth and fifth segments 244*d*, 244*e* are joined by a third single sliding joint 208. The first and second segments 242*a*, 242*b* of the inner liner outer skin 242 are joined by a second double sliding joint 210.

Figure 3:
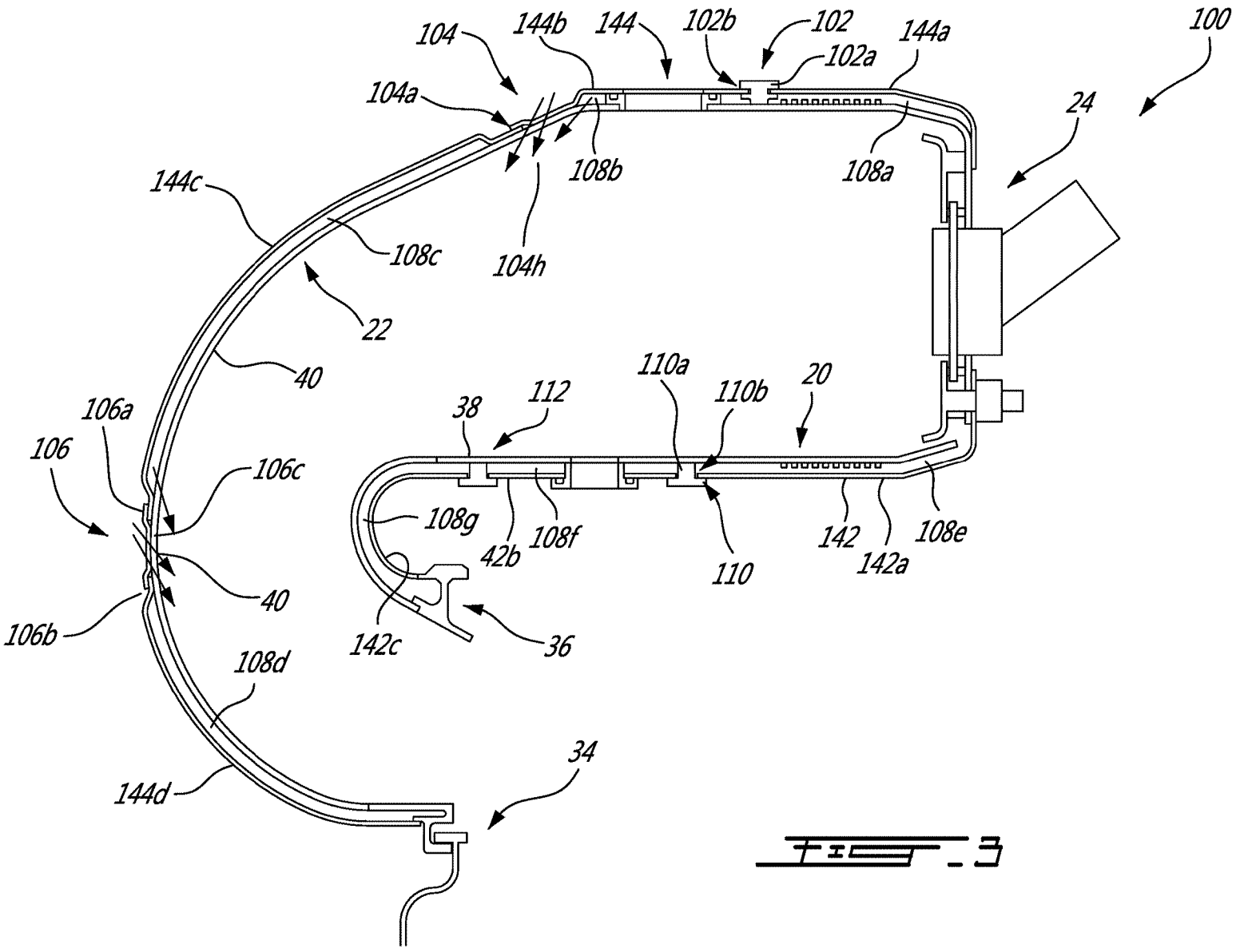
FIG. 3 is a schematic cross-sectional view of another example of a double skin sheet metal combustor.

The first double sliding joint 202 is identical to the double sliding joint 102 of the combustor 100 of FIG. 3. The second double sliding joint 210 is identical to the double sliding joint 106 of the combustor 100 of FIG. 3. The first, second, and third single sliding joints are identical to the single sliding joint 104 of the combustor 100 of FIG. 3.

The first segment 244*a* of the outer liner outer skin 244 is welded to the outer liner inner skin 40 at its upstream extremity near the dome 24 and extends therefrom to the first double sliding joint 202. Downstream ends of the second, third, and fourth segments 244*b*, 244*c*, 244*d* are welded on the outer liner inner skin 40 to define the first, second, and third single sliding joints 204, 206, 208.

In the embodiment shown, the first segment 242*a* of the inner liner outer skin 242 is welded to the inner liner inner skin near the combustor dome 24 and extends therefrom to the second double sliding joint 210. The second double sliding joint 210 is substantially identical to the second double sliding joint 106 described in reference to FIG. 3. In the depicted embodiment, the gap 212 at the large exit duct defines three cavities 212*a*, 212*b*, 212*c*, similar to the embodiment of FIG. 2. The gap 212 at the inner liner 20 defines two cavities 212*d*, 212*e*. The gap 212 includes a sixth cavity 212*f* upstream of the LED 30 of the outer liner 22.

In a particular embodiment, the gap 50, 108, 212 between the outer and inner skins 38, 40, 42, 44 provide sufficient cooling to avoid using heat shields. Hence, less pieces are susceptible to break during operation and the probabilities of damaging downstream components of the engine 10 might be reduced. Therefore, in a particular embodiment, substantial weight savings might be possible by the removal of the heat shields and by the associated studs and nuts required to attach the heat shields to the outer skins. Hence, performance of the gas turbine engine 10 might be improved. Moreover, as aforementioned, the compressed air from the compressor 14 is used four times. In a particular embodiment, using the compressed air four times increases performances of the gas turbine engine 10 because less air from the compressor 14 is required, hence more air is available for energy extraction in the turbine section 18. Furthermore, splitting the gap in a plurality of cavities allows the gap to cover a greater length of the combustor compared to a configuration where the gap is not split. This also allows the inside pressure of each cavity to be optimized for the changing combustor internal pressure.

Referring to all figures, to assemble the double skin combustor 16 having the radially inner liner 20 and the radially outer liner 22, the segments 44*a*, 44*b*, 44*c* of the outer liner outer skin 44 are joined to the outer liner inner skin 40 via the sliding joints 74, 76. Segments 42*a*, 42*b* of the inner liner outer skin 42 are joined to the inner liner inner skin 38 via the inner sliding joint 78. The radially inner liner 20 is attached to the radially outer liner 22 to define an annular combustion chamber 26 of the double skin combustor 16. In the embodiment shown, the dilution bosses 80, 82 are welded to the inner skin 38, 40 and the outer skins 42, 44 are abutted against the dilution bosses 80, 82. In the embodiment shown, the upstream and downstream LED segments 44*b*, 44*c* are slidably inserted in annular slots 76*e* of the double sliding joints 76; the upstream LED segment 44*b* is inserted in the annular slot 74*f* of the outer sliding joint; and the SED segment 42*b* is slidably inserted in the annular slot of the inner sliding joint 78.

The above description is meant to be exemplary only, and one skilled in the art will recognize that changes may be made to the embodiments described without departing from the scope of the invention disclosed. Any modifications which fall within the scope of the present invention will be apparent to those skilled in the art, in light of a review of this disclosure, and such modifications are intended to fall within the appended claims.

The invention claimed is:

1. A double skin combustor for a gas turbine engine, comprising:

a radially inner liner and a radially outer liner extending from a combustor dome to a combustor outlet to define a combustion chamber, the radially inner liner and the radially outer liner each having a hot skin and a cold skin spaced-apart to define a cooling cavity therebetween, the cold skin of the radially inner liner secured directly to the cold skin of the radially outer liner at the combustor dome, the cold skin of the radially inner liner comprising a first plurality of segments extending from the combustor dome to the combustor outlet and the cold skin of the radially outer liner comprising a second plurality of segments extending from the combustor dome to the combustor outlet, at least two adjacent segments of the first plurality of segments connected by a sliding joint configured to allow relative sliding movement between the at least two adjacent segments of the first plurality of segments, and the second plurality of segments connected by a plurality of sliding joints configured to allow relative sliding movement between adjacent segments of the second plurality of segments, wherein at least one segment of the second plurality of segments includes an upstream end and a downstream end, an upstream sliding joint of the plurality of sliding joints engaged to the upstream end and a downstream sliding joint of the plurality of sliding joints engaged to the downstream end.

2. The double skin combustor defined in claim 1, wherein the cooling cavity between the hot skin and the cold skin of both the radially inner liner and the radially outer liner is compartmentalized along a full length of the radially inner liner and the radially outer liner.

3. The double skin combustor of claim 1, wherein the radially outer liner includes a large exit duct (LED) defining an elbow portion of the double skin combustor, the cooling cavity being compartmentalized into a plurality of individual sub-cavities along the LED, and wherein some individual sub-cavities of the plurality of individual sub-cavities along the LED extend from one of the plurality of sliding joints to a location where the cold skin moves integrally with the hot skin of the radially outer liner.

4. The double skin combustor of claim 1, wherein the cooling cavity between the hot skin and the cold skin of both the radially inner liner and the radially outer liner is compartmentalized into a plurality of individual sub-cavities, and wherein series of air holes are defined in the hot skin of the radially inner liner and of the radially outer liner, the plurality of individual sub-cavities being fluidly connected to the combustion chamber via a respective one of the series of air holes.

5. The double skin combustor of claim 1, wherein the double skin combustor comprises a plurality of dilution bosses and at least one ignitor boss, and the double skin combustor comprises a plurality of sliding joint interfaces:

between the plurality of dilution bosses and both some of the first and some of the second plurality of segments; and between the at least one ignitor boss and a dome segment of the second plurality of segments.

6. The double skin combustor of claim 1, wherein at least some of the second plurality of segments are affixed to the hot skin of the radially outer liner at a joint located between two consecutive ones of the plurality of sliding joints, the joint extending circumferentially all around a central axis of the double skin combustor.

7. The double skin combustor of claim 1, wherein the plurality of sliding joints comprises a double-sided sliding joint projecting from the hot skin of the radially outer liner and away from the combustion chamber, the double-sided sliding joint defining two annular slots in opposed sides thereof for slidably receiving an end of respective ones of two consecutive segments of the second plurality of segments, the two annular slots extending circumferentially around a central axis of the double skin combustor.

8. The double skin combustor of claim 1, wherein the plurality of sliding joints of the cold skin of the radial outer liner includes a first sliding joint projecting away from the combustion chamber and from the hot skin of the radially outer liner, the first sliding joint having:

an annular slot extending circumferentially around a central axis of the double skin combustor and a tab, the annular slot slidably receiving a first one of two consecutive segments of the second plurality of segments, the tab attached to a second one of the two consecutive segments of the second plurality of segments; and wherein the sliding joint of the cold skin of the radial inner liner includes a second sliding joint projecting away from the combustion chamber and from the hot skin of the radial inner liner, the second sliding joint having:

another annular slot extending circumferentially around the central axis of the double skin combustor and another tab, the another annular slot slidably receiving a first one of two consecutive segments of the first plurality of segments, the another tab attached to a second one of the two consecutive segments of the first plurality of segments.

9. The double skin combustor of claim 1, further comprising a boss disposed within a corresponding aperture defined through one of the radially inner liner and the radially outer liner, the boss affixed on the hot skin of the one of the radially inner liner and the radially outer liner, the boss having an annular portion larger than the corresponding aperture, the annular portion slidably abutting against the cold skin of the one of the radially inner liner and the radially outer liner, the annular portion defining an annular abutment surface facing radially outward relative to a central axis of the double skin combustor.

10. The double skin combustor of claim 9, wherein the boss is an ignitor boss affixed on the hot skin of the radially outer liner, the double skin combustor further including a floating collar welded on the ignitor boss, the floating collar defining an annular abutting surface disposed radially outward of the cold skin of the radially outer liner, one of the second plurality of segments slidably received between the ignitor boss and the annular abutting surface.

11. The double skin combustor of claim 1, wherein the radially outer liner includes a large exit duct (LED), the cold skin of the radially outer liner defined by a dome segment of the second plurality of segments that defines the combustor dome and by at least one LED segment of the second plurality of segments, one of the plurality of sliding joints disposed between the dome segment and the at least one LED segment, the one of the plurality of sliding joints extending from the hot skin of the radially outer liner toward the cold skin thereof, the dome segment attached to the one of the plurality of sliding joints, the at least one LED segment slidably received within a slot of the one of the plurality of sliding joints.

12. A combustor skin assembly for a combustor of a gas turbine engine, the combustor skin assembly comprising:

a radially inner liner and a radially outer liner extending from a combustor dome to a combustor outlet and defining therebetween a combustion chamber, the radially outer liner having a hot skin and a cold skin defining a cooling cavity therebetween, the cold skin comprising a plurality of segments and a plurality of sliding joints between the plurality of segments of the cold skin, the plurality of sliding joints configured to allow relative sliding movement between adjacent segments of the plurality of segments, wherein at least one segment of the plurality of segments includes an upstream end and a downstream end and further includes an upstream sliding joint of the plurality of sliding joints engaged to the upstream end and a downstream sliding joint of the plurality of sliding joints engaged to the downstream end, and wherein the cooling cavity is divided into a plurality of individual sub-cavities from the combustor dome to the combustor outlet, some individual sub-cavities of the plurality of individual sub-cavities each being bordered on one end thereof by a respective one of the upstream sliding joint and the downstream sliding joint.

13. The combustor skin assembly of claim 12, wherein the combustor is a reverse flow combustor, the radially outer liner including a large exit duct (LED), the LED defining an elbow for changing a direction of a flow of combustion gases, at least three of the plurality of individual sub-cavities located at the LED.

14. The combustor skin assembly of claim 12, wherein each of the some individual sub-cavities extends from the respective one of the upstream sliding joint and the downstream sliding joint to a location where the cold skin is affixed to the hot skin.

15. The combustor skin assembly of claim 12, wherein series of air holes are defined in the hot skin, each of at least two of the plurality of individual sub-cavities fluidly connected to the combustion chamber via a respective one of the series of air holes.

16. The combustor skin assembly of claim 12, wherein two consecutive segments of the plurality of segments are joined by one of the plurality of sliding joints that defines two annular slots slidably receiving each a respective one of the two consecutive segments, the two annular slots extending all around a central axis of the combustor skin assembly.

17. The combustor skin assembly of claim 12, wherein the plurality of sliding joints includes a first sliding joint projecting away from the combustion chamber and from the hot skin, the first sliding joint having:

an annular slot extending circumferentially around a central axis of the combustor skin assembly and a tab, the annular slot slidably receiving a first one of two consecutive segments of the plurality of segments, the tab attached to a second one of the two consecutive segments.

18. The combustor skin assembly of claim 12, further comprising a boss disposed within a corresponding aperture defined through the radially outer liner, the boss welded on the hot skin, the boss having a flange larger than the corresponding aperture, the flange slidably abutting against the cold skin, the flange defining an annular abutment surface oriented radially outward relative to a central axis of the combustion chamber.

19. A method of assembling a double skin combustor having a radially inner liner and a radially outer liner both having a hot skin and a cold skin spaced-apart to define a cooling cavity therebetween, and both extending from a combustor dome to a combustor outlet, comprising:

joining a first plurality of segments of the cold skin of the radially outer liner to the hot skin of the radially outer liner via a plurality of sliding joints configured to allow relative sliding movement between adjacent segments of the first plurality of segments, and wherein at least one segment of the first plurality of segments includes an upstream end and a downstream end and further includes an upstream sliding joint of the plurality of sliding joints engaged to the upstream end and a downstream sliding joint of the plurality of sliding joints engaged to the downstream end;

joining at least two adjacent segments of a second plurality of segments of the cold skin of the radially inner liner to the hot skin of the radially inner liner via a sliding joint configured to allow relative sliding movement between the at least two adjacent segments of the second plurality of segments;

wherein the first plurality of segments and the second plurality of segments extend from the combustor dome to the combustor outlet; and attaching the radially inner liner to the radially outer liner by attaching the cold skin of the radially inner liner directly to the cold skin of the radially outer liner at the combustor dome, to define an annular combustion chamber of the double skin combustor.

20. The method of claim 19, wherein attaching the radially inner liner to the radially outer liner includes attaching a radially-outwardly protruding portion of the cold skin of the radially inner liner directly to a radially-inwardly protruding portion of the cold skin of the radially outer liner to define the combustor dome of the double skin combustor.

* * * * *